US008011100B2

(12) United States Patent
Fath

(10) Patent No.: US 8,011,100 B2
(45) Date of Patent: Sep. 6, 2011

(54) METHOD FOR PRODUCING ELECTROPLATED PLASTIC SANITARY ARTICLES

(75) Inventor: Andreas Fath, Haslach (DE)

(73) Assignee: Hansgrohe AG, Schiltach (DE)

( * ) Notice: Subject to any disclaimer, the term of this patent is extended or adjusted under 35 U.S.C. 154(b) by 720 days.

(21) Appl. No.: 11/570,666

(22) PCT Filed: May 30, 2006

(86) PCT No.: PCT/EP2006/005122

§ 371 (c)(1),
(2), (4) Date: Jun. 4, 2007

(87) PCT Pub. No.: WO2006/128664

PCT Pub. Date: Dec. 7, 2006

(65) Prior Publication Data

US 2007/0251826 A1 Nov. 1, 2007

(30) Foreign Application Priority Data

Jun. 3, 2005 (DE) ..... 10 2005 026 633

(51) Int. Cl.
*B23P 15/16* (2006.01)

(52) U.S. Cl. ..... 29/890.143; 29/890.142; 205/158

(58) Field of Classification Search ..... 29/890.142, 29/890.143; 205/158; 285/55, 266, 345, 285/379

See application file for complete search history.

(56) References Cited

U.S. PATENT DOCUMENTS 4,275,908 A * 6/1981 Elkins et al. ..... 285/55

FOREIGN PATENT DOCUMENTS

| | | |
|---|---|---|
| DE | 18 01 819 | 4/1969 |
| DE | 41 23 985 | 1/1993 |
| DE | 195 10 855 | 9/1996 |
| DE | 196 19 254 | 10/1997 |
| WO | WO0131094 A1 | 5/2001 |
| WO | WO 03/096859 | 11/2003 |

OTHER PUBLICATIONS

European Patent Office, European Search Report for EP Appln. No. 06743085.0-2119, in the name of Hansgrohe AG, issued Nov. 5, 2008.

* cited by examiner

*Primary Examiner* — Rick K Chang
(74) *Attorney, Agent, or Firm* — Duane Morris LLP

(57) ABSTRACT

In a method for producing plastic sanitary articles having surfaces metallized by electroplating, the sanitary article has at least one electrically nonconductive component, before said article is metallized by electroplating using an external current source. This component at least partially decouples the water-bearing regions of the sanitary article from the current flow during metallization by electroplating using the external current source. The component is preferably a separate component which can be reversibly connected to the sanitary article.

Figure 1:
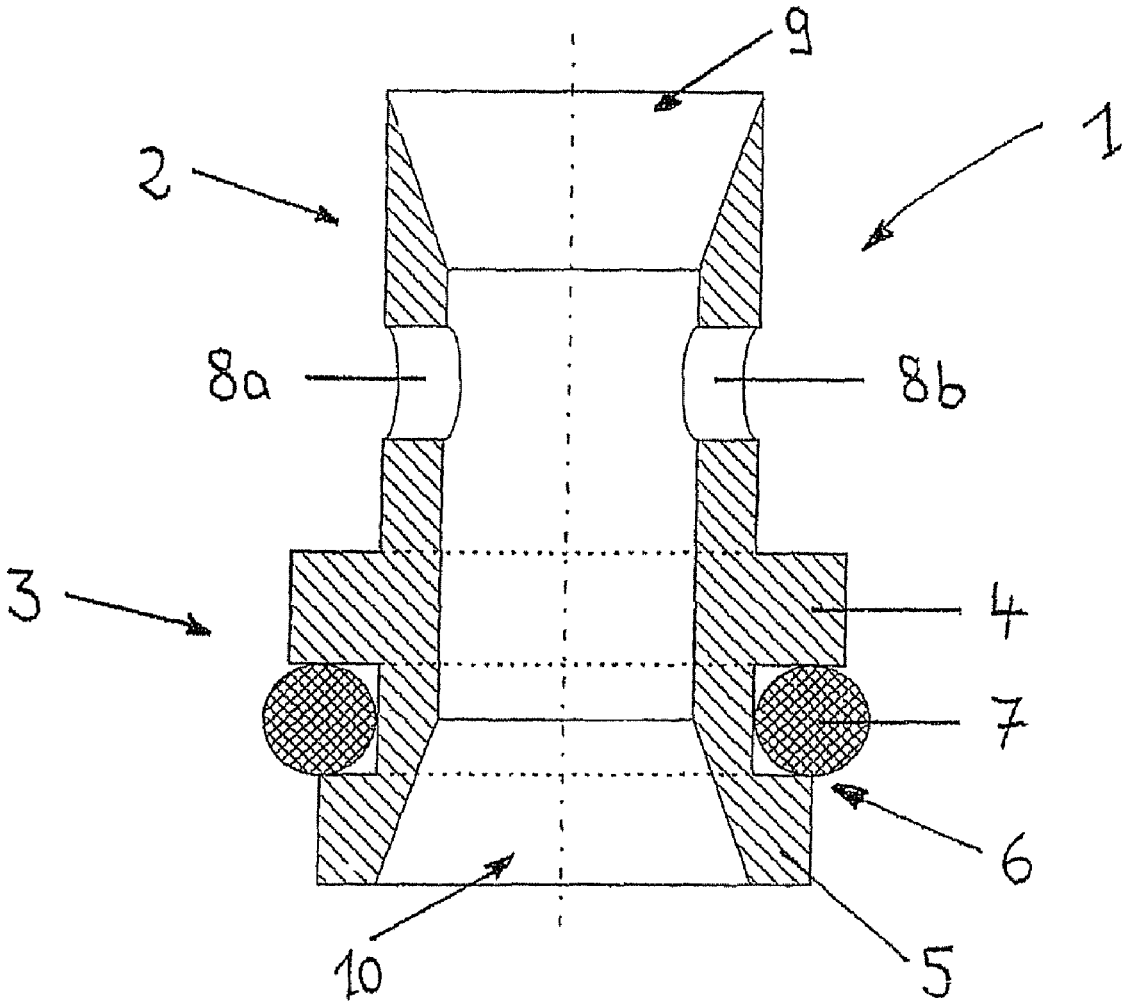

The invention also includes the component for decoupling the current itself, and a sanitary article which is provided with the component.

19 Claims, 3 Drawing Sheets

METHOD FOR PRODUCING ELECTROPLATED PLASTIC SANITARY ARTICLES

The invention relates in the first instance to a method for producing plastic sanitary articles having surfaces metallized by electroplating, to a component that can be used in the case of this method and to sanitary articles provided with this component.

Electroplated plastics, i.e. plastic materials with metal coatings, are indispensable in the production of sanitary articles. A preferred plastic material to be mentioned here by way of example is ABS (acrylonitrile-butadiene-styrene copolymer), which is electroplated in particular with chromium as the outermost covering layer. The production of electroplated plastic sanitary articles can be carried out efficiently and cost-effectively, in particular because there is no need for any grinding or polishing, as is necessary in the case of metal elements. In addition to this there are the favorable design possibilities brought about by using the plastics injection-molding technique and also a considerable weight reduction in comparison with sanitary articles with metal elements.

Said electroplated plastic sanitary articles are produced in method steps that are known in principle to a person skilled in the art. For instance, a pretreatment process is usually necessary to make the plastic surface electrically conductive, in order that adequate adhesion of the metal layers applied under an electric current (i.e. using an external current source) on the plastic is ensured. With the pretreatment that is usually carried out without an electric current, normally all the regions of the surface of the treated article are uniformly made electrically conductive. The main reason for this is that the treatment solutions that are used for the electroless pretreatment have free access to all the outer and inner surfaces of the article. In the case of sanitary articles, this means that the water-bearing regions also become electrically conductive at least partially with their corresponding surfaces in this pretreatment. This in turn has the consequence that the metals that are deposited in the subsequent metallization by electroplating using an external current source, such as chromium, are also to be encountered on the corresponding surfaces of the water-bearing regions. In this connection, it is said that the metals used in the electroless pretreatment and in the metallization by electroplating using an external current source are "interspersed" into the water-bearing regions of the sanitary article. Depending on the metal used, this interspersion may go to varying extents and depths.

In the case of such sanitary articles with metal depositions in the water-bearing regions, there is in principle the risk of the corresponding metals passing over into the water or of the corresponding metal layers even becoming detached. This applies in particular whenever the sanitary articles are used in geographical regions in which only a comparatively aggressive drinking water is available, for example drinking water with a high sulfate content, high oxygen content and/or comparatively low pH of <7. Malfunctions may then occur as a result of the deposited metal layers, for example copper and/or nickel layers, being undermined and flaking away. In the case of many sanitary articles, for example hand-held shower attachments with a molded-in water-bearing channel and in the water distribution chamber in the shower head, this leads to clogging of the spray disk. In the case of mixer fittings with corresponding design features, the perlators etc. become clogged. In addition, with all sanitary articles there is the possibility of the water/drinking water that flows through the water-bearing regions becoming contaminated with a wide variety of metals by chemical dissolution of the deposited metals.

At least in the water-bearing regions, therefore, no metallic coating should be deposited during the metallization by electroplating using an external current source. This problem is also known from other technical areas in which electrically nonconductive articles are to be coated with metals in restricted locations. For instance, German patent specification DE-C3-1,801,819 discloses a method in which articles (in that case operating knobs for radio devices) are only to be partially electroplated. This is achieved there by making narrow notches/grooves on the surface of the article. This is intended to have the effect that the conductivity is reduced for certain surface regions in such a way that no metal is deposited in these regions during metallization by electroplating using an external current source. Just the fact that, according to this patent, the depth and cut-in angle of the notch have to be made to match the current density that is used makes the method described insufficiently reliable in production. Furthermore, the required notches/grooves cannot be provided on every surface, since they cannot be subsequently removed.

To solve this problem in the area of sanitary engineering, it has already been proposed by the applicant itself, in WO 03/096859 A2, to apply a covering layer or protective layer to at least part of the surfaces of the sanitary article, in order to decouple the water-bearing regions of the sanitary article from the current flow during metallization by electroplating using the external current source. The corresponding layers in this case comprise a lacquer, which is applied in a suitable way, in particular by printing it on by what is known as the pad printing process.

This procedure may, however, lead to difficulties in practical use. On the one hand, the preferred pad printing process is a comparatively demanding technique, which can only be mastered by qualified personnel. Furthermore, in the case of sanitary articles, the covering/protective layer must be applied to comparatively complicated geometries, which in turn requires qualified personnel and takes a considerable amount of time. Finally, the lacquers used for the corresponding layers are complicated to use and to some extent toxic, so that corresponding precautions have to be taken in production.

All the difficulties mentioned have in practice led to various manufacturers avoiding the problem from the outset, for example by subsequently placing a separate tube part into the water-bearing part of the sanitary article, for example the shower, after coating by electroplating. As a result, the water flows through this additionally inserted tube and does not come into contact with the inner walls of the sanitary article. However, it goes without saying that this procedure means that a further method step has to be included in the production of the corresponding sanitary article.

The invention accordingly has the object of making it possible in the case of plastic sanitary articles to carry out metallization by electroplating (under current flow) that is targeted only on specific surface regions. In particular, the deposition of metals in the water-bearing regions of the sanitary article is to be reliably prevented. It is intended in this case that the corresponding method can be integrated as smoothly as possible in existing production processes and that the quality of the metallization on the decorative surfaces of the sanitary article is not impaired.

This object is achieved by the method having the features of claim 1. Preferred embodiments of this method are represented in the dependent claims 2 to 15. The component that can be used with preference in this method is defined in claims 16 to 18. Claim 19 describes the sanitary article provided with the component, preferred embodiments of the sanitary article being the subject of the dependent claims 20 to 28. A support according to the invention for the electroplating is disclosed in claims 29 and 30. The wording of all the claims is hereby incorporated in this description by reference.

In the case of the method according to the invention for producing plastic sanitary articles having surfaces metallized by electroplating, before it is metallized by electroplating using an external current source the sanitary article has at least one electrically nonconductive component which at least partially, preferably completely, decouples the water-bearing regions of the sanitary article from the current flow during metallization by electroplating using the external current source.

Therefore, by contrast with the embodiment in WO 03/096859, a component and not a covering or protective layer is used for the decoupling of the water-bearing regions of the sanitary article. This leads to some decisive advantages, which are explained in more detail below.

In the case of the method according to the invention, the component mentioned may in a first group of embodiments be formed on the sanitary article itself. In the case of these embodiments, the component forms as it were part of the sanitary article itself. In this case, the component may be integrated in the structure of the sanitary article in such a way that, after performing its function of decoupling the water-bearing regions from the current flow, it can remain on the sanitary article. It may also be preferred if, after performing its function, this component can be detached or separated from the sanitary article, for example by the presence of a suitable predetermined breaking point, with the aid of which the component can be separated from the sanitary article itself by hand or with a suitable tool.

In the case of a second group of preferred embodiments of the method according to the invention, said component is in the form of a preferably separate component which can be connected to the sanitary article or can interact with it in a comparable way. Here, too, the component is formed in particular in such a way that it can be reversibly connected to the sanitary article, i.e. after performing its function can be removed from the sanitary article in a simple way.

In the case of such embodiments, the preferably separate component can preferably be fitted together with the sanitary article, in particular inserted into it. This allows the mentioned reversible connectability with the sanitary article to be realized in a simple way.

In the case of the embodiments mentioned, the preferably separate component is preferably in the form of a sleeve. In this way it can interact with the corresponding water-bearing parts of a sanitary article, which usually have circular cross-sectional areas. The necessary sealing between the sleeve-like component and the sanitary article is in this case achieved for example by the outer surface of the component, or else a portion or projection that is provided there, together with the inner surface of the article, or a (peripheral) notch or groove provided there. In order to achieve a sealing form fit between the component and the sanitary article, in the case of the sleeve-like components mentioned there is preferably at least one sealing element on the outer circumference of the component, the sealing elements being in particular customary sealing rings.

In further configurations of the invention, in which a preferably separate component is used, this component can preferably be at least partially introduced into the sanitary article. This can be realized for example by the component being placed into a recess or clearance provided on the sanitary article, in particular in the manner of a (preferably peripheral) groove. In these cases, the preferably separate component is preferably of annular design, it also being possible here in particular for them to be customary sealing rings.

In a development of the invention, clearances or openings are provided in the component described and can serve for various purposes. In particular, such clearances or openings serve for holding retaining elements for the component, i.e. such retaining elements that are required or useful for the function of the component in the metallization by electroplating.

In the case of the method according to invention, in principle various sanitary articles can be metallized by electroplating. Preferred sanitary articles are sanitary outlet devices such as fittings, showers, hand-held shower attachments and the like. Preferably concerned here are sanitary articles in the production of which the water-bearing parts or regions are injection-molded at the same time.

The sanitary article which is metallized by electroplating according to the invention is in particular a shower or a shower head, preferably a hand-held shower attachment.

In the case of such a sanitary article, the component described is provided at what is known as the water inlet and/or at what is known as the water outlet. The precise arrangement of the component on the sanitary article is also explained in more detail later in connection with the drawings.

In the case of the embodiment last mentioned, the component is preferably in the form of a sleeve-like component and then provided at or in the water inlet. In a likewise preferred way, the component may also be in the form of a sealing ring and is then provided at or preferably in the water inlet.

In a comparable way, in the case of such embodiments the component is preferably in the form of a sealing ring and is then provided at the water outlet, or the component is preferably in the form of a sleeve-like component and is then provided at the water outlet.

The component described in connection with the invention is preferably made of plastic. In particular, PVDF (polyvinylidene fluoride) or PTFE (polytetrafluoroethylene) may be used in particular as the plastic.

In the case of the invention, the sanitary article itself, in particular the shower or the shower head, is made of plastic, what is known as a thermoplastic preferably being used. In particular, the sanitary article is in these cases made of ABS.

Apart from the described method according to the invention, the invention also comprises the already described component itself, which is intended for the production of plastic sanitary articles having surfaces metallized by electroplating by means of metallization by electroplating using an external current source. This component is characterized according to the invention in that it is made of an electrically nonconductive material and is in the form of a sleeve.

This component according to the invention preferably has on the outer circumference at least one sealing element, preferably at least one sealing ring. Furthermore, the component may have in particular clearances or openings, which are intended for holding retaining elements for the component when it is performing its function.

With respect to the disclosure of the component according to the invention, reference is expressly made to the corresponding passages in the description of the method according to the invention.

Finally, the invention also comprises plastic sanitary articles, in particular showers or shower heads, which are connected to at least one separate component which at least partially decouples the water-bearing regions of the sanitary article from the current flow during metallization by electroplating using an external current source.

With respect to the detailed configuration of the sanitary articles according to the invention, reference can be made to the above description in connection with the method according to the invention. The corresponding statements made are hereby also expressly intended to apply to the description of the sanitary article according to the invention.

For instance, as already described, the component may be formed directly, for example integrally, on the sanitary article. After performing its function, the component may then either remain on the sanitary article or be separated again from it.

In the case of other embodiments, as they have likewise already been presented, the component may allow itself to be reversibly connected to the sanitary article. Here it has likewise already been explained that the component can then preferably be fitted together with the sanitary article or inserted into it. The sleeve-like components mentioned or the annular components described may be mentioned here as structural alternatives, it being possible for clearances or openings to be provided in the component. As mentioned, the component is preferably made of plastic, in particular of PVDF or PTFE.

The sanitary article according to the invention is preferably a hand-held shower attachment. The sanitary article is preferably made of a thermoplastic, in particular of ABS.

Finally, the invention also comprises a support in the form of an electroplating stand, which according to the invention is provided with at least one of the described sleeve-shaped components according to the invention. As still to be explained later, these components can already be placed on the support, i.e. the electroplating frame, before the sanitary articles to be elctroplated are placed on the support. In particular, in this case the components can be fastened to corresponding retaining elements of the support by means of the clearances and openings preferably provided there. In this way, sanitary articles can be fastened directly to the components on the support, for example inserted into the corresponding openings of a hand-held shower attachment and additionally electrically contacted. This facilitates the operating procedures in production. If appropriate, the components can then remain on the support and also be used for the electroplating of further sanitary articles.

The invention has a whole series of advantages over the prior art described at the beginning. For instance, the decoupling of the water-bearing regions or parts of the sanitary article in the case of the invention takes place with a component which is either formed onto the article or can be connected to it in a simple way. This dispenses with the subsequent application of a covering or protective layer which, as mentioned at the beginning, is comparatively complicated and time-consuming. Furthermore, in the case of the invention there is no need to handle chemical substances such as lacquers or the like, so that no corresponding work safety regulations have to be observed. Finally, in the case of the invention the described components can, if appropriate, be removed again from the sanitary article in a simple way, which in the case of applying covering or protective layers is either not possible at all or only possible with great effort. If appropriately embodied, the components can even be used again after their removal from the sanitary article. Finally, in the case of the invention further functions can be integrated into the component, for example a means of securing the sanitary article during the metallization by electroplating can be provided by means of the component (see the clearances or openings that are present if appropriate). In addition, the invention can be integrated in a particular way in methods in which the plastic articles are made conductive by the method known as direct metallization (see later). All this makes the invention superior to the described embodiments of the prior art.

Before components according to the invention and the sanitary article according to the invention are described in detail, a customary procedure for the metallic electroplating of sanitary articles is to be briefly discussed. This description, which is merely given by way of example, is intended to serve for better understanding of the method according to the invention.

In a development, the method according to the invention is preferably set up in such a way that the surfaces of the sanitary article are pretreated before the metallization by electroplating using an external current source. This preferably applies to all the surfaces. Pretreatment steps of a form known from the prior art may be used here.

Preferably, the pretreatment comprises at least one degreasing or pickling step, a pretreatment with an agent having an oxidizing effect being mentioned in particular. In principle, a wide variety of oxidizing agents may be used here, for example potassium permanganate solution, it being possible to select different agents according to the plastic material of the sanitary article that is used. Preferred oxidizing agents are acids, a treatment with solutions containing chromic acid (with or without sulfuric acid) being notable here. The pretreatment with solutions containing chromic acid is appropriate in particular in the case of plastic articles of ABS.

Furthermore, in the case of the method according to the invention, the pretreatment comprises at least one activation step, which usually follows on from the degreasing or pickling step. The activation may in this case take place in a number of steps, an activation in two steps being preferred.

According to the invention, what is known as electroless chemical metallization is carried out in particular as the activation. In this case, metals are deposited from suitable solutions without an external current source. Various procedures for this are known and they can be used separately from one another or else in combination with one another.

On the one hand, solutions which contain tin or palladium may be used for chemical metallization. In the case of tin, the solutions preferably contain tin ions, while the palladium may be contained in the solutions in ionic form or else in metallic form (preferably colloidal).

On the other hand, the chemical metallization may take place with the aid of solutions which contain cobalt ions. These cobalt ions are then converted into cobalt sulfide in a second step.

In certain cases, for example in the the case of chemical metallization with tin or palladium, a further electroless chemical metallization may preferably follow on. For this further metallization, solutions containing copper ions and/or preferably nickel ions may then be used.

It is possible to dispense with the chemical metallization if what is known as direct metallization is used to make the plastic conductive. Direct metallization means that, after pretreatment and activation, an electrolytic layer (under current flow) can be built up directly. This reduces the number of production steps and simplifies the method altogether. Specifically when such direct metallizations are used, the method according to the invention with its component according to the invention brings additional advantages, since altogether a metallization of the water-bearing parts of a sanitary article can be reliably prevented and the method is altogether further simplified.

In the case of preferred embodiments of the method according to the invention, in the metallization by electroplating using an external current source, which in particular follows on from the pretreatment steps mentioned above, preferably layers of nickel, copper or chromium are applied. Chromium is to be mentioned here as a preferred metal.

Furthermore, it is preferred if, in the metallization by electroplating using an external current source, layers, and in particular outermost covering layers, of at least one precious metal or of binary, ternary or quaternary alloys of such metals are applied. The advantages of such metals as layers, in particular covering layers, are obvious on account of their chemical resistance. Gold and the metals of the group of metals known as platinum metals are to be mentioned as preferred precious metals.

According to the invention, it is further preferred if, in the metallization by electroplating using an external current source, a layer sequence is applied, wherein this layer sequence finishes off with an outermost covering layer of chromium. The advantages of chromium plating as the outermost covering layer likewise do not have to be particularly pointed out and are known to a person skilled in the art. Of these embodiments, those in which layers of nickel and/or copper are located under the covering layer of chromium are further preferred.

In a development, the method according to the invention may be set up in such a way that, after the metallization by electroplating using an external current source, a posttreatment takes place. This posttreatment preferably concerns all the surfaces of the sanitary article. The posttreatment comprises in particular what is known as stripping, in which a conductive layer (metal layers) that has been applied if appropriate by electroless chemical deposition is removed again. The stripping is preferably performed by treating the corresponding surfaces with an oxidizing agent, in particular oxidizing acid. The oxidizing agent may be in particular nitric acid or solutions which contain in particular persulfate or hydrogen peroxide. The stripping preferably has the effect of removing all the metal layers not deposited with current. In this way, the water-bearing parts of the sanitary article become completely metal-free, so that the disadvantages presented at the beginning cannot occur. Metal layers only remain on those surfaces, in particular on the decorative surfaces, on which they can be accepted and cannot become detached during use of the sanitary article, for example the chromium layers of the outermost covering layer.

The features described and further features of the invention are evident from the following description of preferred embodiments in conjunction with the subclaims and the drawings. In this respect, the individual features can in each case be realized by themselves or in combination with one another.

Figure 2:
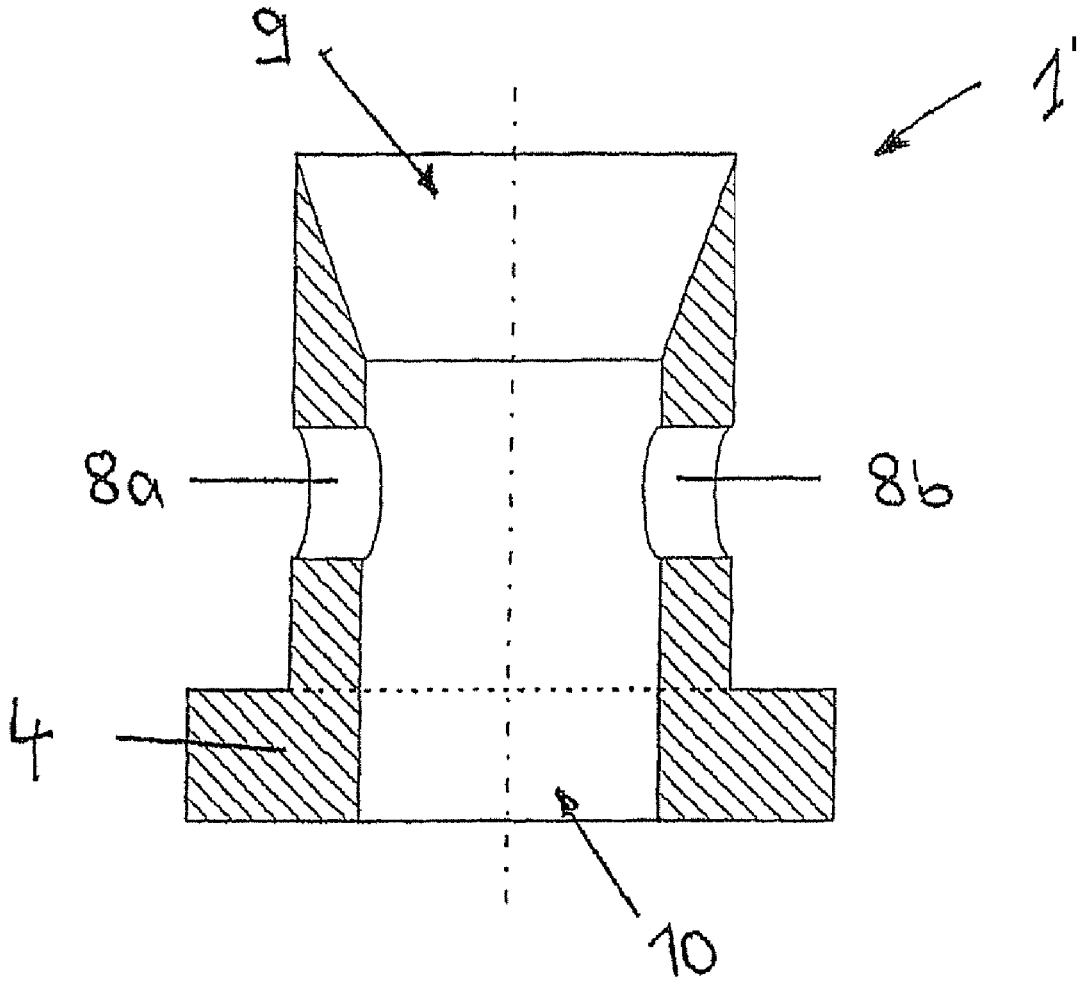
Figure 3:
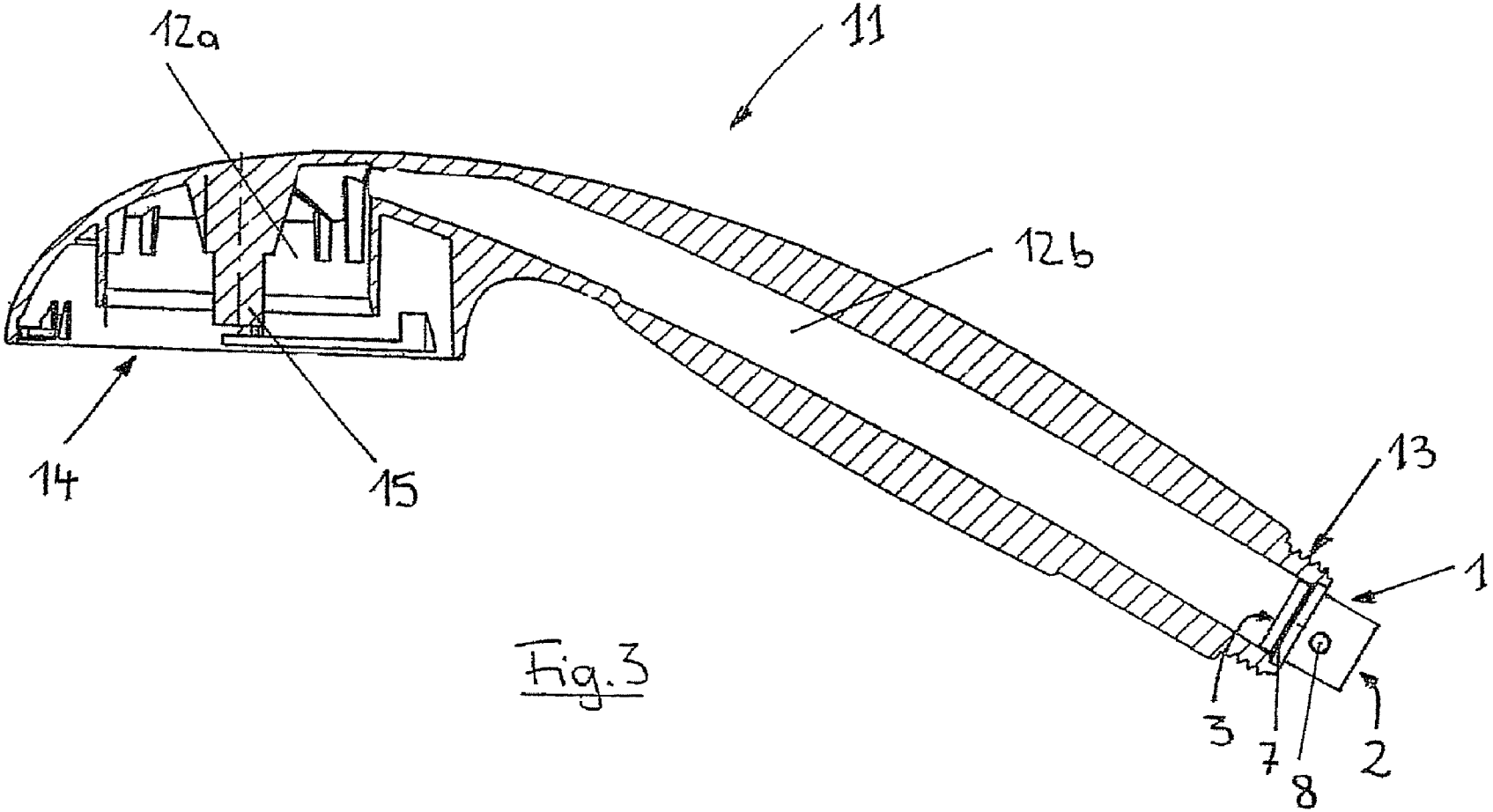

In the drawings:

FIG. 1 shows the schematic sectional view of a component according to the invention, as used in the case of the method according to the invention, FIG. 2 shows the schematic sectional view of a further component according to the invention, as used in the case of the method according to the invention, and FIG. 3 shows the schematic sectional representation of a sanitary article according to the invention with a component according to the invention.

FIG. 1 shows the component 1 according to the invention in a sectional view. This component is produced in a customary way, known to a person skilled in the art, from PVDF.

The component 1 is configured in the form of a sleeve with a circular cross-sectional area and has a first portion 2, which is directly adjoined by a second portion 3. Portion 3 has a projection 4, which runs around the outer circumference of the component 1 and together with a further projection 5 forms a groove-like clearance 6. Placed in this clearance 6 is a sealing element 7 in the form of a sealing ring, which protrudes beyond the projections 4 and 5 and consequently provides for the component 1 a corresponding sealing surface with an outward sealing effect. The interaction of the sealing element 7 with the corresponding surfaces of the sanitary article is explained in more detail below, in connection with FIG. 3.

In the portion 2 of the component 1 there are two, mutually opposite openings 8*a* and 8*b*, which can hold at least one retaining element for the component 1. This is also explained in more detail in connection with FIG. 3.

At the ends 9 of the portion 2 and 10 of the portion 3, the walls of the component 1 are reduced. As a result, the introduction and removal of the component from the corresponding openings of the sanitary article is facilitated by means of the increased elasticity of the corresponding regions.

As FIG. 1 reveals, the component 1 is an embodiment of the component according to the invention in which the component 1 is configured as a separate component. It may interact in the way represented in FIG. 3 with a sanitary article and assume its function in the metallization by electroplating.

FIG. 2 shows a further component 1' according to the invention in a sectional view. Since its construction is similar to the construction of the component 1, reference can be made to the description of the component 1. For reasons of clarity, the same designations have also largely been used.

The component 1' is likewise configured in the form of a sleeve with a circular cross-sectional area. At its lower end 10, according to FIG. 2, the component 1' has a projection 4, which runs around the outer circumference and can interact in a sealing manner with a corresponding clearance on a sanitary article. The sealing function is ensured in spite of dispensing with an additional sealing element 7 in comparison with the embodiment of the component according to the invention as shown in FIG. 1. This simplifies the structural design and production of the component 1' in comparison with the component 1.

In addition, the component 1' also has two, mutually opposite openings 8*a* and 8*b*, which can hold at least one retaining element for the component 1. In this respect, reference can likewise be made to the description in connection with FIG. 3.

At the end 9 (the upper end according to FIG. 2) of the component 1, the wall thickness is likewise reduced, in order to facilitate increased elasticity here for the introduction and removal of the component from the corresponding openings of the sanitary article.

FIG. 3 shows a sanitary article according to the invention in the form of a hand-held shower attachment 11, which is produced in the customary way, known to a person skilled in the art, by the injection-molding process, preferably from ABS. The water-bearing regions 12*a* (water chamber) and 12*b* (water-bearing channel) that merge one into the other can be clearly seen, with their associated (inner) surfaces. These water-bearing regions are flowed through by the water/drinking water in the functional state of the sanitary article, to be precise in the direction from the water inflow region (water inlet 13) to the water outflow region (water outlet 14).

As already explained in the description, metal deposition is to be avoided in the water-bearing regions, i.e. on the (inner) surfaces of these regions, during the metallization by electroplating. For this purpose, according to FIG. 3, a component 1 according to FIG. 1 is introduced into the water inlet 13, in the present case is inserted into it. In this case, the portion 3 of the component 1 according to FIG. 1 is introduced into the water inlet 13, the sealing element 7 together with the projection 4 interacting with positive engagement with the inner wall of the water inlet 13. By the sealing connection, a current flow in the direction of the water-bearing regions (12*b*, 12*a*) is reliably prevented during the electroplating. According to FIG. 3, the portion 2 of the component 1 with its openings 8*a* and 8*b* protrudes from the water inlet 13 and on the one hand assists the decoupling from the current flow and on the other hand provides by way of the openings 8*a* and 8*b* a possibility for securing the component 1 or the hand-held shower attachment 11 during the coating by electroplating itself.

The securement is accomplished for example by one or two retaining rods being guided through the two opposite openings 8*a* and 8*b*, the retaining rods preferably being provided on a support for the coating by electroplating of the hand-held shower attachment 11. In a corresponding way, other retaining rods may act on the hand-held shower attachment 11 in the region of the water outlet 14. Then the hand-held shower attachment 11 only has to be electrically contacted, preferably at the water inlet 13 and at the water outlet 14, and the electrodeposition can begin.

It goes without saying that, in a corresponding way, the component 1' according to FIG. 2 can be introduced into the hand-held shower attachment 11.

In the case represented according to FIG. 3, a component 1 according to the invention is only present at the water inlet 13. In these cases, the duration of the metallization by electroplating under current flow can be controlled on the basis of empirical values to ensure that only the outer (decorative) surfaces of the hand-held shower attachment 11 are coated with metal and no (undesired) coating of the water-bearing regions over the water outlet 14 takes place. Since, with this procedure, the metal layer is created by epitaxial growth, beginning from the water inlet 13, in these cases the coating by electroplating can simply be terminated at the appropriate time.

However, it is quite possible also to provide a component 1 according to the invention in the water outlet 14, also ensuring that a corresponding decoupling of the water-bearing regions from the current flow is obtained there. In such cases, a corresponding component according to the invention may for example be fitted over the projection 15 of the water outlet 14.

It is also evident from the explanations relating to FIG. 3 that other structural designs of a component according to the invention are possible for the method according to the invention. It is for example possible for an appropriate sealing ring to be provided in a corresponding groove at the water inlet 13, in a groove provided there. Then the sealing ring in this groove assumes the function of current decoupling. Comparable embodiments can also be realized at the water outlet 14.

EXAMPLE

For further explanation of the method according to the invention, an example of a suitable procedure is presented below. It goes without saying that the invention is not intended in any way to be restricted by this example.

A hand-held shower attachment, as represented in FIG. 3, of ABS, for example Novodur P2MC (Bayer AG, Germany) or Ronvalin TP55 (BASF AG, Germany) is provided before the entire electroplating treatment with a component according to the invention, as represented in FIG. 1. For this purpose, the component is inserted into the water inlet of the hand-held shower attachment in the way represented in FIG. 3. With the aid of retaining elements the hand-held shower attachment is then fixed on the electroplating stand. In this respect, it is also possible to proceed by first placing the components according to the invention onto all the corresponding retaining elements and then fitting the hand-held shower attachments together with the components already fastened on the electroplating stand.

The shower element prepared in this way, fixed on the electroplating stand, runs through the entire electrodepositing process on the basis of the run-through principle. By way of example, this electrodepositing process may take the following form:

1. Pickling in 1000 g/l of $CrO_3$, 55 g/l of Cr III
   65° C. 10 min.
   or in 380 g/l of $CrO_3$, 380 g/l of $H_2SO_4$, 20 g/l of Cr III
   65° 10 min.
   In both cases, the pickling solutions contain for instance fluorosurfactant FT248 (Bayer AG) for better wetting.
2. Reducing remains of hexavalent chromic acid with a solution of 10 g/l of hydroxyl ammonium sulfate room temperature 1-2 min.
3. Preliminary immersion in dilute hydrochloric acid solution
   1 part concentrated hydrochloric acid—2 parts water
   room temperature 1 min.
4. Activation in a colloidal Sn/Pd solution of a commercially available kind such as Ultraplast activation S41 (the Enthone company, Langenfeld)
   100 mg/l of Pd, 5 g/l of Sn II
   35° C. 5 min.
5. Acceleration in a solution containing oxalic acid such as Ultraplast activation S52 (the Enthone company, Langenfeld)
   50 g/l of oxalic acid, 55° C., 5 min.
6. Chemical nickel plating with commercially available chemical nickel solutions such as Ultraplast-Ni-S76 (the Enthone company, Langenfeld)
   5 g/l of Ni, 30 g/l of sodium hypophosfite 1-hydrate
   pH about 9.0 37° C. 10 min.
7. Pickling in 100 g/l of $H_2SO_4$
   room temperature 1 min.
8. Preliminary nickel plating in a sulfamate-nickel bath
   70 g/l of Ni, 40 g/l of boric acid
   10 g/l of chloride, 50° C. 2 A/dm$^2$
   5-10 min.
   After this working step, the selective mechanism is already visible. The outer regions have a preliminary nickel layer, the water chamber and the inner wall of the water-bearing channel have remained in the state of chemical nickel plating.
9. Pickling in 100 g/l of $H_2SO_4$
   room temperature 1 min.
10. Bright copper plating in sulfuric bright-copper electrolyte
    45 g/l of Cu, 100 g/l of $H_2SO_4$
    40 mg/l of chloride 3 A/dm$^2$
    30 min.
    brightener system such as for example Cuprorapid 1518 (the Enthone company, Langenfeld).
11. Pickling (oxidative) Dekabunt SE (the Enthone company, Langenfeld)
    room temperature 1 min.
    (system of Na-hydrogen sulfate, fluoride and Na-persulfate).
12. Bright nickel plating (customary Watts solution of nickel sulfate, nickel chloride and boric acid)
    70 g/l of Ni, 15 g/l of chloride, 40 g/l of boric acid
    60° C., 4 A/dm$^2$, 10 min.
    commercially available brightener system such as Elpelyt SF (the Enthone company, Langenfeld).

13. Cr activation, for example 10 g/l of $CrO_3$, 2 g/l Cr III
50 mg/l of $H_2SO_4$, 50 mg/l of fluoride
room temperature 1 min.
can be cathodically assisted, about 30 mA/dm$^2$.
14. Bright chromium plating 350 g/l of $CrO_3$, 2 g/l of Cr III
1.4 g/l of $H_2SO_4$, 0.6 g/l of fluoride
43° C. 4 min.
15. Reducing remains of hexavalent chromic acid with a solution of 10 g/l of hydroxyl ammonium sulfate
room temperature 1-2 min.
16. Drying in circulating air 70° C. 10 min.
It goes without saying that adequate purging operations must be carried out between the individual working steps.
17. Stripping of the conducting layer in the water-bearing region
for example 2 parts water-1 part 53% nitric acid, room temperature, about 60 sec., until remains of the conductive layer have been completely removed. It goes without saying that this step may also be integrated directly in the automatic electrodepositing unit between items 15 and 16.

The method can be varied in a variety of ways, for example a. Direct metallizing:
Replacement of step 4 by a colloidal Sn/Pd solution with higher Pd concentration, for example 240 mg/l. Replacement of step 5 by alkaline copper-containing solution to form Pd/Cu clusters.
Then dispensing with the chemical nickel plating and preliminary nickel plating. Copper plating is carried out directly.

b. Ionogenic activation:
The colloidal Sn/Pd solution may be substituted by a solution containing palladium sulfate, chromic acid and sulfuric acid. The accelerator then contains an organic boron-hydrogen compound with sodium hypophosfite. Method steps 2 and 3 are dropped. The chromium sulfuric acid as a pickling solution plus about 10 mg/l of Pd also applies to direct metallizing.

c. Nickel only method:
Preliminary nickel plating (item 8), pickling (item 9) and bright copper plating (item 10) are combined into one working step in a sulfamate-nickel bath. Item 11 must then not contain any persulfate. $H_2SO_4$ pickling then suffices.

d. Covering layers other than chromium:
Chromium is undoubtedly the standard surface for sanitary fittings. However, the covering layer could also consist of pure gold, hard gold, platinum, palladium, ruthenium etc., as long as the covering layer is resistant to the stripping medium.

The invention claimed is:

1. A method for producing a plastic sanitary article having surfaces metallized by electroplating which comprises, before the sanitary article is metallized by electroplating using an external current source, providing the sanitary article with at least one electrically nonconductive component, wherein said electrically nonconductive component at least partially decouples water-bearing regions of the sanitary article from current flow during metallization by electroplating using the external current source, wherein the sanitary article is a shower head and the water-bearing regions are where water and/or drinking water flow therethrough.

2. The method as claimed in claim 1, characterized in that the component is a separate component which can be reversibly connected, to the sanitary article.

3. The method as claimed in claim 2, characterized in that the separate component can be fitted together with the sanitary article by inserting into the sanitary article.

4. The method as claimed in claim 2, characterized in that the component is a sleeve-like component, with at least one sealing element which is arranged on an outer circumference of the component.

5. The method as claimed in claim 4, wherein the at least one sealing element is at least one sealing ring.

6. The method as claimed in claim 2, characterized in that the component can be at least partially introduced into the sanitary article by placing into a groove-like recess provided on the sanitary article.

7. The method as claimed in claim 6, characterized in that the component is of annular design and is a sealing ring.

8. The method as claimed in claim 7, characterized in that the component is a sealing ring.

9. The method as claimed in claim 2, characterized in that clearances or openings are provided in the component, in particular for holding retaining elements for the component.

10. The method as claimed in claim 1, characterized in that the shower head is a hand-held type.

11. The method as claimed in claim 10, characterized in that the component is provided at the water inlet and/or at the water outlet of the shower head.

12. The method as claimed in claim 11, characterized in that the component is in a form of a sleeve-like component and is provided at or in the water inlet.

13. The method as claimed in claim 11, characterized in that the component is in a form of a sealing ring and is provided at or in the water inlet.

14. The method as claimed in claim 11, characterized in that the component is in a form of a sealing ring and is provided at the water outlet.

15. The method as claimed in claim 11, characterized in that the component is in a form of a sleeve-like component and is provided at the water outlet.

16. The method as claimed in claim 1, characterized in that the component is made of plastic.

17. The method as claimed in claim 16, characterized in that the plastic is polyvinylidene fluoride (PVDF).

18. The method as claimed in claim 1, characterized in that the sanitary article is made of a thermoplastic.

19. The method as claimed in claim 18, characterized in that the thermoplastic is acrylonitrile butadiene styrene (ABS).

* * * * *